United States Patent [19]

Keeler

[11] Patent Number: 4,890,837

[45] Date of Patent: Jan. 2, 1990

[54] GOLF PUTTER

[76] Inventor: Harry A. Keeler, 385 High Crest Dr., West Milford, N.J. 07480

[21] Appl. No.: 144,566

[22] Filed: Jan. 15, 1988

[51] Int. Cl.[4] ..... A63B 53/14

[52] U.S. Cl. ..... 273/81.4; 273/77 R; 273/80.7; 273/80.1

[58] Field of Search ..... 273/162 R, 165, 81.4, 273/80.1, 80.7, 80 R, 80 B, 77 B, 77 R, 80 D, 81 B; 135/65, 66, 67, 76, DIG. 11; D21/217, 218, 219, 215

[56] References Cited

U.S. PATENT DOCUMENTS

| | | | |
|---|---|---|---|
| 1,457,528 | 6/1923 | Jordan | 273/80 B |
| 1,688,473 | 10/1928 | Sippel | 273/80 B |
| 2,086,974 | 7/1937 | Belfore | 273/165 |
| 2,092,839 | 9/1937 | Gouverneur | 273/81.4 |
| 2,298,505 | 10/1942 | Ottman | 273/81.4 |
| 2,782,796 | 2/1957 | Blue | 135/65 |
| 2,843,384 | 7/1958 | Schmidt | 273/77 B |
| 3,326,554 | 6/1967 | Scully | 273/81.4 |
| 4,648,598 | 3/1987 | Kim | 273/81 B |

*Primary Examiner*—George J. Marlo
*Attorney, Agent, or Firm*—Seed and Berry

[57] ABSTRACT

A golf putter wherein the upper end of the shaft provides an integral handle. Discrete deformations are provided over the majority of the shaft length including the handle in order to provide a variety of distinctive locations for gripping the putter.

3 Claims, 1 Drawing Sheet

FIG. 1
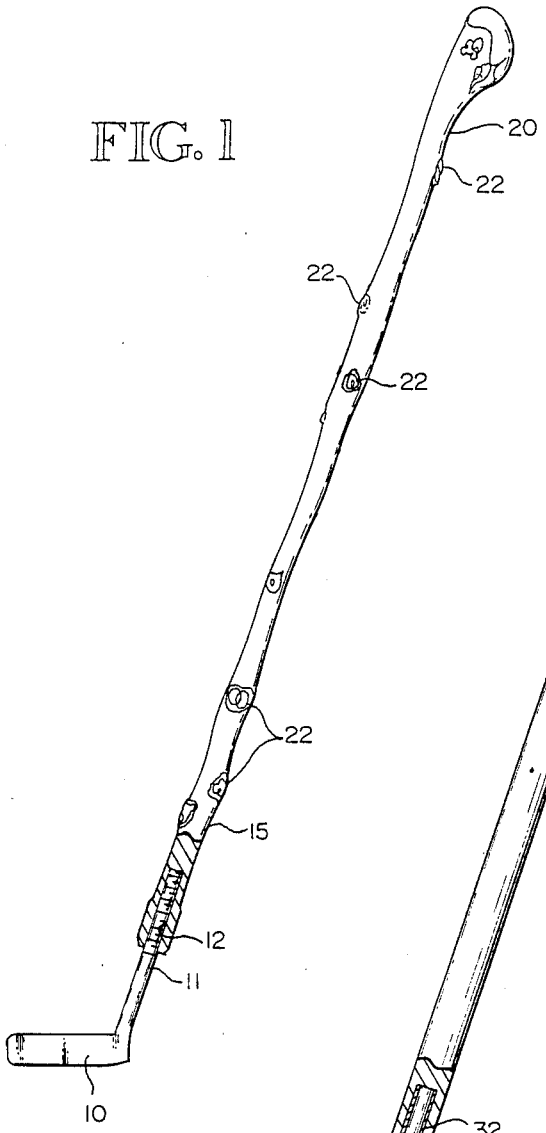
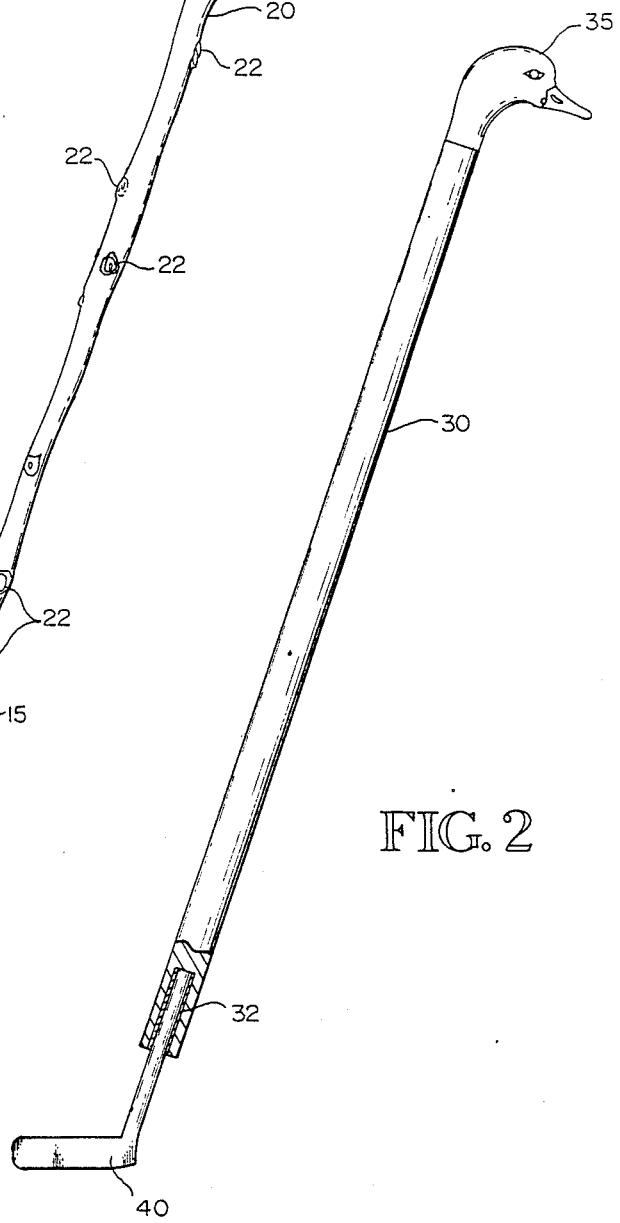
FIG. 2

GOLF PUTTER

BACKGROUND OF THE INVENTION

This invention relates generally to golf clubs. More specifically, the invention relates to the golf clubs known as putters.

Golf clubs are the implements used for striking the ball used in the game of golf. A golfer will use a variety of different clubs, each club specific for the type of shot to be made. Although different types of clubs are employed, most are characterized by a design stressing the ability to impart an appropriate amount and kind of force to the golf ball during the player's swing. The underlying desire is to propel the ball an appropriate distance, thus reducing the total swings or strokes needed to complete the game.

To achieve this purpose, the club design usually incorporates a long thin shaft terminating in a relatively heavy club head. The club head has a flattened surface for striking the ball. The above design results in the capability of transferring an appropriate amount of momentum to the ball during the swing. Further refinements include complex weighting systems in the club head, altering shaft stiffness, and exotic shaft and club head materials. The focus of these design efforts has been on the mechanical attributes of the club as analyzed from a classical physics perspective dealing with force and momentum transfer. Such analysis is suitable for clubs specifically designed for greater hitting distance.

A particular golf club design is disclosed in U.S. Pat. No. 3,326,554.

In another facet of the game of golf call "putting," the player is required to strike the ball relatively gently, causing it to roll towards and into the cup on the putting green. Generally, a player carries one club, a "putter" entirely dedicated to putting. Since putting stresses accuracy over distance, the design of the putter is inherently different from that of the other clubs discussed above.

Golf putter designs are disclosed in U.S. Pat. Nos. 2,949,304 and 4,252,317.

Successful putting is a critical aspect to the game of golf since it can represent up to 50% of the player's total score. Thus, there is a tremendous interest in designing effective putters.

For the most part, past putter designs rely on the same techniques and analysis used for clubs other than putters. This results in a variety of shaft and club head modifications all with mechanical attributes focused on the physics of momentum transfer.

Such attributes are of only modest importance in putting. Accurate putting is contingent on the player being able to regulate with a high degree of accuracy, both the amount and direction of force applied to the ball. Further, since most putting greens are relatively small, only a limited amount of force is ever needed. Accurate putting depends upon the "feel" of the putter and familiarity a player has with the putter. A putter design that increases the player's comfort by improving the feel of the putter may have a significant desirable impact on putting accuracy.

The search has continued for new putters having improved comfort and feel. This invention was made as a result of that search.

OBJECTS AND SUMMARY OF THE INVENTION

Accordingly, it is a general object of this invention to avoid or substantially alleviate problems associated with prior art putters.

A more specific object of the present invention is to provide a putter having improved comfort and feel.

Other objects and advantages of the present invention will become apparent from the following summary of the invention and description of its preferred embodiments.

The present invention provides a putter which comprises a club head and a shaft attached to that head. The shaft is a conventional walking stick. The shaft has at the end opposite the club head a handle which has on its surface a plurality of discrete deformations. The walking stick is characterized by distinct physical properties that impart a unique feel to the handle. These properties include a modulated handle surface and an ornamental shape at the apex of the handle.

BRIEF DESCRIPTION OF THE DRAWINGS

FIG. 1 is a cross-section of one embodiment of the putter of the present invention.

FIG. 2 is a cross-section of a second embodiment of the putter of the present invention.

DETAILED DESCRIPTION OF THE INVENTION

As discussed above, the present invention provides a putter which comprises a club head and a walking stick. The walking stick forms the shaft and handle of the putter.

The club head used may be any club head that is conventionally used or which is designed for use with a conventional putter. Such club heads are known to those skilled in the art. Normally, the club head provides a flattened hitting surface and an elongated throat for connection with the remainder of the club.

The club head may be attached to the walking stick by any means known to those skilled in the art to form such an attachment. Suitable methods of attachment include adhesives, cements, threaded shaft and throat, pressure fit, banded or pinned joint, and interference fit.

The term "walking stick" as used in this specification is meant to include any walking stick known to those skilled in this are so long as it has a length, diameter, and slope of the aggregate dimension to make it useful as a handle on a putter. Such walking sticks include swaggers, shillelaghs, canes, hiking sticks, staffs, shepherds crooks, and others known to those skilled in this art so long as the walking stick has a distinctively shaped handle and shaft.

In one embodiment, the handle of the walking stick may incorporate a plurality of surface perturbations randomly distributed across the handle surface. These perturbations extend over the majority of the handle and shaft providing a variety of locations for the player to grip the putter.

In another embodiment, the handle of the walking stick has a relatively smooth surface with the termination of the handle characterized by a distinctively shaped apex. This apex may be an ornamental design.

The material used for the walking stick portion of the putter is not critical, and may be any of those traditionally used in walking sticks known to those skilled in the art. A preferred material from the standpoint of shape, surface characteristics, and weight is wood. Polymeric materials and composites thereof are also suitable materials. The surface of the walking stick may be left uncoated or may be coated with one or more varnishes or other surface enhancing substances. The purpose of the coating is to protect the substrate material, provide a better grip, and to enhance the overall appearance of the club.

In use, the putter of the present invention will generate a unique feel to the user. More particularly, the player will feel the distinctive shape, the individual bumps and the surface imperfections of the handle. Each time the player grips the handle these surface imperfections will act as a marker and a signal to the player about the appropriateness of his present grip relative to his prior putting attempts. In this way, the player is able to more precisely position his hands on the handle based on the success or lack thereof in his prior putting efforts. A general familiarity with the handle surface is attained after multiple uses. This familiarity results from the feel of the club and provides the player with more comfort and confidence in his stroke.

Other significant attributes of the walking stick putter will contribute to the overall feel and familiarity described above. These include the relatively heavy and thick shaft of the walking stick and the unusual weight distribution resulting from the ornamental apex of the handle. Through successive use, the feel of the putter becomes more refined and precise, increasing the accuracy of each swing.

FIG. 1 represents a cross section of one embodiment of the putter of the present invention. Club head 10 is attached to walking stick shaft 15 by threaded throat 11 which corresponds to threaded entrance 12. Handle 20 is characterized by a plurality of randomly distributed surface perturbators 22.

In FIG. 2, a second embodiment is disclosed. This embodiment is characterized by generally smooth handle 30 terminating in apex 35, an ornamental design having the shape of a duck head. In this particular design, club head 40 is attached to shaft 30 by adhesive 32.

Since the present invention employs a walking stick as a major component, it is understood that the putters of the present invention may be efficiently manufactured from existing walking sticks at relatively low cost.

The principles, preferred embodiments and modes of operation of the invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

I claim:

1. A golf putter comprising a club head having a flattened surface for striking a golf ball; and attached to said head a shaft devoid of substantial material performations and extending from a point where the shaft attaches to the head to an upper integral handle end and designed for a two handed grip which has over the majority of the shaft length, including said handle end, a plurality of discrete deformations which improve the feel and comfort of the putter whereby a golfer using said putter any grip the shaft at any place along the length of the shaft, including said deformations, where feel and comfort dictate.

2. The putter of claim 1 wherein the shaft is made of wood.

3. The putter of claim 2 wherein the shaft is coated with a protective varnish.

* * * * *

UNITED STATES PATENT AND TRADEMARK OFFICE

CERTIFICATE OF CORRECTION

PATENT NO. : 4,890,837

DATED : January 2, 1990

INVENTOR(S) : Harry A. Keeler

It is certified that error appears in the above-identified patent and that said Letters Patent is hereby corrected as shown below:

In claim 1, column 4, line 24, delete "material performations" and substitute therefor --lateral perforations--.

In claim 1, column 4, line 31, delete "any" and sustitute therefor --may--.

Signed and Sealed this

Fifteenth Day of January, 1991

*Attest:*

HARRY F. MANBECK, JR.

*Attesting Officer*

*Commissioner of Patents and Trademarks*